US009813832B2

(12) United States Patent
Maalouf et al.

(10) Patent No.: US 9,813,832 B2
(45) Date of Patent: Nov. 7, 2017

(54) MATING ASSURANCE SYSTEM AND METHOD

(71) Applicant: TYCO ELECTRONICS CORPORATION, Berwyn, PA (US)

(72) Inventors: Khalil John Maalouf, Chambersburg, PA (US); Rodney Kenneth Spade, Elizabethtown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/005,572

(22) Filed: Jan. 25, 2016

(65) Prior Publication Data

US 2016/0249147 A1 Aug. 25, 2016

Related U.S. Application Data

(60) Provisional application No. 62/119,475, filed on Feb. 23, 2015.

(51) Int. Cl.
*H04R 29/00* (2006.01)
*H01R 13/639* (2006.01)
(Continued)

(52) U.S. Cl.
CPC ..... *H04R 29/005* (2013.01); *G10L 21/0224* (2013.01); *H01R 13/639* (2013.01);
(Continued)

(58) Field of Classification Search
CPC ..... H04R 3/005; H04R 2420/00; H04R 2420/05; H04R 2420/09; H04R 2430/20; H04R 1/06; H04R 29/005; H01R 24/58; H01R 13/703; H01R 13/639; H01R 13/641; H01R 43/26; G10L 21/0224
See application file for complete search history.

(56) References Cited

U.S. PATENT DOCUMENTS 8,186,216 B2 5/2012 Ogawa et al.
2010/0242599 A1* 9/2010 Ogawa ..... H01R 13/641 73/488
(Continued)

FOREIGN PATENT DOCUMENTS

DE 103 08 403 A1 9/2004
DE 10 2012 004165 A1 9/2013
(Continued)

OTHER PUBLICATIONS

International Search Report, Application No. PCT/US2016/016491, dated Feb. 4, 2016.

*Primary Examiner* — Thang Tran

(57) ABSTRACT

A mating assurance system includes first and second microphones configured to be located in a vicinity of a mating zone for electrical connectors. The first microphone is located a first distance from the mating zone and the second microphone being located a second distance from the mating zone. The first and second microphones are configured to detect audible sound when the electrical connectors are mated. An output unit is connected to the first and second microphones and receives audio signals from the first and second microphones. The output unit processes the audio signals from the first microphone and from the second microphone for mating assurance.

18 Claims, 4 Drawing Sheets

(51) Int. Cl.

| | |
|---|---|
| ***H04R 3/00*** | (2006.01) |
| ***G10L 21/0224*** | (2013.01) |
| ***H04R 1/06*** | (2006.01) |
| ***H01R 13/641*** | (2006.01) |
| ***H01R 43/26*** | (2006.01) |

(52) U.S. Cl.
CPC ..... *H01R 13/641* (2013.01); *H01R 43/26* (2013.01); *H04R 1/06* (2013.01); *H04R 3/005* (2013.01); *H04R 2420/00* (2013.01); *H04R 2430/20* (2013.01)

(56) References Cited

U.S. PATENT DOCUMENTS

| | | | | |
|---|---|---|---|---|
| 2014/0203945 | A1 | 7/2014 | Benner et al. | |
| 2015/0098574 | A1* | 4/2015 | Fry ..... | H04R 29/004 381/56 |

FOREIGN PATENT DOCUMENTS

| | | | |
|---|---|---|---|
| EP | 2 161 796 | A1 | 3/2010 |
| JP | 03297080 | A | 12/1991 |
| JP | 07185952 | A | 9/1995 |
| JP | 2006-221971 | A | 8/2006 |
| JP | 2007-004073 | A | 1/2007 |
| JP | 2008-226506 | A | 9/2008 |
| WO | 2006/075263 | A1 | 7/2006 |

* cited by examiner

MATING ASSURANCE SYSTEM AND METHOD

CROSS REFERENCE TO RELATED APPLICATIONS

This application claims the benefit of U.S. Provisional Application No. 62/119,475 filed Feb. 23, 2015 titled MATING ASSURANCE SYSTEM AND METHOD, the subject matter of which is herein incorporated by reference in its entirety.

BACKGROUND OF THE INVENTION

The subject matter herein relates generally to mating assurance systems and methods.

Insuring that mating pairs of electrical connectors are mated properly is important in electrical systems, particularly in electrical systems that exhibit vibration during operation, such as in automotive applications. For example, an electrical connector can be partially mated during a car assembly process, such as in a car assembly factory, and can pass conventional electrical assurance tests, such as tests that pass electrical signals through the electrical connectors to determine electrical connection of the connectors. However, once in operation, the car vibration can cause the electrical connectors to come loose and cause failure.

Conventional assembly methods for electrical connectors provide a mating mechanism, such as a latch, that produces a click when the latch latches in place. However, in an assembly situation, a worker may not properly hear the click due to background factory noises, or could confuse the click with other sounds that closely resemble a connector click. Some known systems use a double casing of the connector, where a second case only fits if the electrical connectors were properly mated. However, such systems have increased cost associated with the second case and increased labor time to assemble.

A need remains for a mating assurance system and method to detect proper mating of electrical connectors.

BRIEF DESCRIPTION OF THE INVENTION

In one embodiment, a mating assurance system is provided including first and second microphones configured to be located in a vicinity of a mating zone for electrical connectors. The first microphone is located a first distance from the mating zone and the second microphone being located a second distance from the mating zone. The first and second microphones are configured to detect audible sound when the electrical connectors are mated. An output unit is connected to the first and second microphones and receives audio signals from the first and second microphones. The output unit processes the audio signals from the first microphone and from the second microphone for mating assurance.

In a further embodiment, a mating assurance system is provided including first and second microphones configured to be located in a vicinity of a mating zone for electrical connectors. The first and second microphones are configured to detect audible sound. An output unit is connected to the first and second microphones and receives audio signals from the first and second microphones. The output unit processes the audio signals from the first microphone and from the second microphone to determine a direction of origination of the audible sounds.

In another embodiment, a method of detecting electrical connector mating is provided including positioning a first microphone in a vicinity of a mating zone for the electrical connectors and positioning a second microphone in a vicinity of the mating zone for the electrical connectors. The method includes detecting audible sounds with the first and second microphones when the electrical connectors are mated and transmitting audio signals based on the audible sounds detected by the first and second microphones to an output unit. The method includes processing the audio signals from the first and second microphones at the output unit.

DETAILED DESCRIPTION OF THE INVENTION

Figure 1:
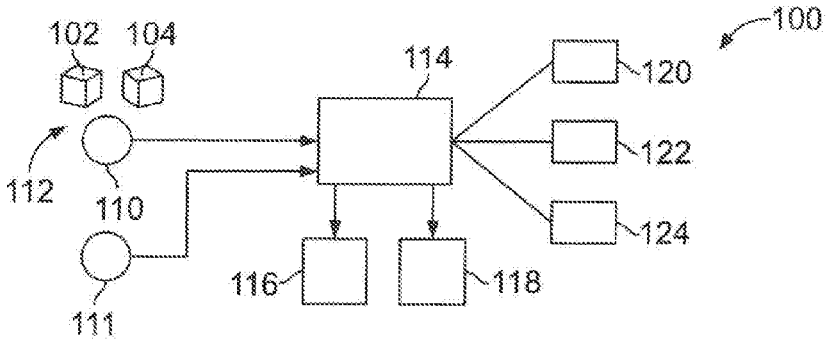
FIG. 1 illustrates a mating assurance system formed in accordance with an exemplary embodiment.

FIG. 1 illustrates a mating assurance system 100 formed in accordance with an exemplary embodiment. The mating assurance system 100 provides feedback to an assembler to confirm that two components, such as a pair of electrical connectors 102, 104, are properly mated. The mating assurance system 100 may be used for assurance of mating of other types of components in other embodiments, such as for latching of parts other than electrical connectors, such as door panels. While the system is described hereafter in reference to assurance of mating of electrical connectors, the subject matter herein is not intended to be limited to such.

In an exemplary embodiment, the mating assurance system 100 detects an audible sound, such as a latching sound or click, when the electrical connectors 102, 104 are mated. The mating assurance system 100 may use real time signal processing for mating assurance. The mating assurance system 100 may provide mating assurance as to the mating status of the connectors 102, 104 (e.g., confirmation that the connectors 102, 104 have been mated or that the connectors 102, 104 have not been mated). The mating assurance system 100 may provide feedback to the assembler of the mating status of the electrical connectors 102, 104 for mating assurance. The audible verification aspect of the mating assurance system 100 may be used in conjunction with an electronic verification system or other quality control systems that tests the electrical connection between the electrical connectors 102, 104 as a secondary verification system.

The mating assurance system 100 includes a plurality of microphones that are located in a vicinity of a mating zone 112 for the electrical connectors 102, 104. In the illustrated embodiment, a first microphone 110 and a second microphone 111 are illustrated; however any number of microphones may be used in various embodiments. The microphones 110, 111 may be omnidirectional microphones. In an exemplary embodiment, the microphones 110, 111 are positioned at different first and second distances from the mating zone 112, such that the first and second microphones 110, 111 may receive the audible sound at different times (e.g., the second microphone 111 may be positioned further from the electrical connectors 102, 104 such that the audible sound made when the electrical connectors 102, 104 are mated is received at a later time at the second microphone 111 as compared to the first microphone 110). The mating assurance system 100 may use the time difference to determine the relative distances between the microphones 110, 111 and the electrical connectors 102, 104 and/or to determine a direction of sound origination (e.g., the direction of the mating zone 112). The mating assurance system 100 may ignore audio signals determined to originate from a direction other than the mating zone, which reduces the amount of data that needs to be processed and enhances the speed of processing of the mating assurance system 100. Using multiple microphones 110, 111 may enhance reliability of the sound detection of the mating assurance system 100 as compared to systems that use a single microphone. Using multiple microphones 110, 111 may reduce the probability of false positive identification of connector mating as compared to systems that use a single microphone. Using multiple microphones 110, 111 allows collecting audio signals from different angles to provide enhanced signal signature matching capabilities and/or for determining angular orientation of the electrical connectors 102, 104 when mated. Optionally, the mating zone 112 may be positioned beyond the first microphone 110 such that the first microphone 110 is positioned between the mating zone 112 and the second microphone 111. In other embodiments, the mating zone 112 may be positioned between the first and second microphones 110, 111. The mating zone 112 may be staggered forward of, rearward of, or to one side or the other of the first microphone 110 and/or the second microphone 111.

The microphones 110, 111 are connected to one or more output unit(s) 114 and the output unit 114 receives audio signals from the microphones 110, 111. The microphones 110, 111 may be connected to the output unit 114 by a wired or a wireless connection. The output unit 114 may be a computer that processes the audio signals and provides feedback to the assembler based on the audio signals. In an exemplary embodiment, the output unit 114 compares the audio signals from the microphones 110, 111 for enhanced mating assurance. The output unit 114 may compare the time of receipt of the audio signals from the microphones 110, 111 during processing. The output unit 114 determines if the electrical connectors 102, 104 are properly mated based on the audio signals as a form of audible verification of proper mating. The output unit 114 determines or verifies if the audible sound received at the microphones 110, 111 originated from mating of the electrical connectors 102, 104 and/or filters out the audio signals if it is determined that the audible sound was form a source other than the mating of the electrical connectors 102, 104. For example, the output unit 114 may filter background noise if the output filter determines that the audible sound was from a source other than the mating of the electrical connectors 102, 104, which may enhance the audible sound for the assembler. For example, by using multiple microphones 110, 111, the output unit 114 may determine the direction of origin of the audible sound and may filter out audible sounds that are determined to occur from a direction outside of the mating zone 112, such as from a direction behind the second microphone 111 or from a direction too remote from the mating zone 112 to be occurring from the mating of the electrical connectors 102, 104. The mating assurance system 100 may include other microphones in or around the mating zone 112 that listen for background noise and the output unit 114 may compare the audio signals from each of the microphones to isolate the audible sounds associated with mating the electrical connectors 102, 104 from the background noise. The output unit 114 may have other means of filtering the background noise detected by the microphones.

In an exemplary embodiment, the first microphone 110 and/or the second microphone 111 may be held by the assembler proximate to the assembler's hand. For example, the microphones 110, 111 may be strapped to the assembler's hand or may be integrated into a glove worn by the assembler. In one particular embodiment, the first microphone 110 may be worn by the assembler at or near the assembler's finger tips, and thus at or near the mating zone 112, while the second microphone 111 may be worn by the assembler at or near the assemblers wrist, and thus outside of, but near enough to detect the audible sounds of, the mating zone 112. In other embodiments, rather than being worn by the assembler, the first microphone 110 and/or the second microphone 111 may be fixed or mounted in a particular location within the mating zone 112 in the vicinity where the assembler is mating the electrical connectors 102, 104. The first microphone 110 and/or the second microphone 111 may be embedded into or otherwise coupled to the electrical connectors 102 and/or 104.

In an exemplary embodiment, the mating assurance system 100 may be adapted for use in an area where visibility of and accessibility to the mating zone 112 is limited. For example, the electrical connectors 102, 104 may be part of wire harnesses that are assembled and mated during assembly of a car in an automotive plant. The electrical connectors 102, 104 may be mated in an area under the hood, behind the engine, behind the dashboard, under a seat, or in other difficult to see areas, making use of the audible clicking sound when the electrical connectors 102, 104 are mated. The mating assurance system 100 enhances the audible sound providing various types of feedback to the assembler to ensure that the electrical connectors 102, 104 are properly mated. Additionally, the mating of the electrical connectors 102, 104 may occur in a noisy environment, such as in an assembly plant, manufacturing plant or elsewhere where the audible click made when the latching of the electrical connectors 102, 104 may be unheard by the assembler.

Figure 2:
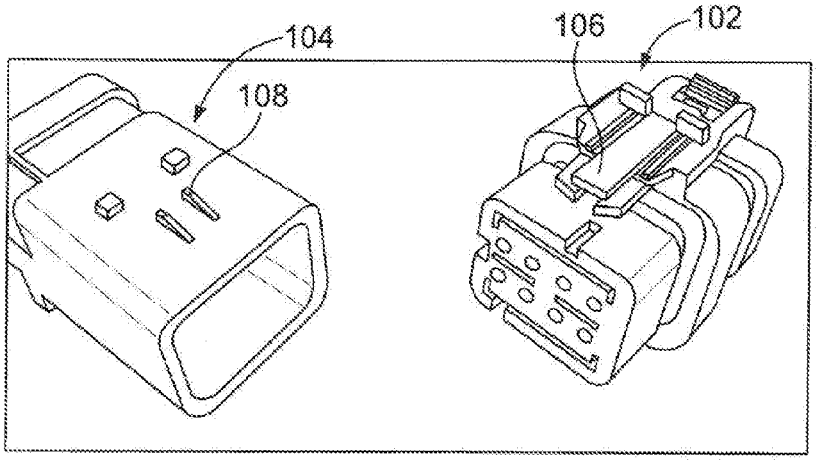
FIGS. 2 and 3 illustrate exemplary embodiments of different types of electrical connectors which may utilize the mating assurance system shown in FIG. 1.
Figure 3:
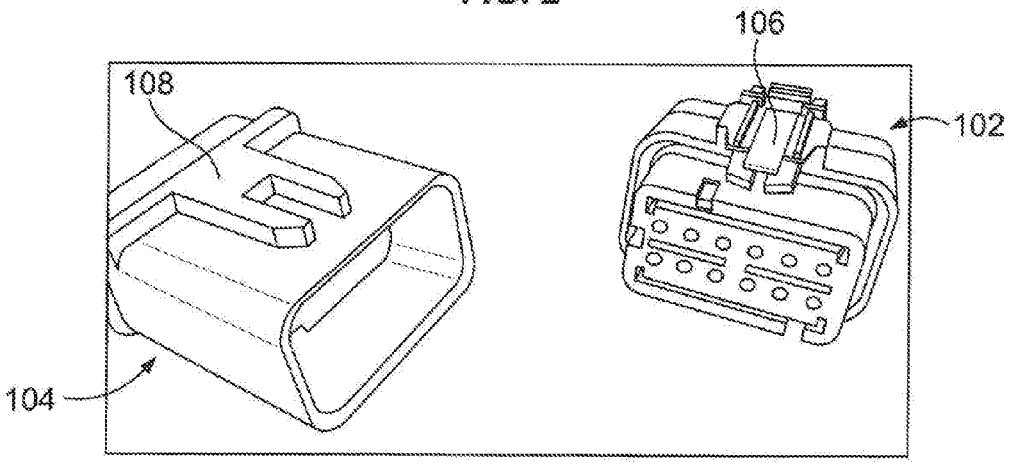

The electrical connectors 102, 104 may be any type of electrical connectors. In an exemplary embodiment, the mating assurance system 100 may be used during assembly of automotive electrical connectors. The electrical connectors 102, 104 may be sealed or unsealed connectors. FIGS. 2 and 3 illustrate exemplary embodiments of different types of electrical connectors 102, 104. For example, FIG. 2 illustrates an eight position header 102 and an eight position receptacle 104 having eight contacts and associated wires extending therefrom. The electrical connectors 102, 104 illustrated in FIG. 3 are twelve position header 102 and receptacle 104 connectors having twelve contacts and associated wires. Other types of electrical connectors 102, 104 may be provided in alternative embodiments, such as two position connectors, four position connectors, six position connectors, ten position connectors, fourteen position connectors, and the like. Other types of electrical connectors 102, 104 other than rectangular connectors, such as circular connectors, may be provided in other alternative embodiments. The electrical connectors 102 and/or 104 may be board mounted connectors rather than being cable or wire connectors, such as a header connector that is integrated or coupled to equipment or components within the vehicle. The connectors may have different types or sized latches having different audible characteristics during latching.

The mating assurance system 100 may be used for connector identification purposes, such as to identify latching of the eight position connectors as compared to the twelve position connectors (or other types of connectors). The mating assurance system 100 may be used to identify the mating orientation of the electrical connectors 102, 104, such as to determine if the electrical connectors 102, 104 are top-up, bottom-up, side-up and the like as the audible characteristics of the latching sound or click may be different based on the orientation of the electrical connectors 102, 104. The mating assurance system 100 may have different templates for the various orientations for enhanced signal processing.

In the exemplary embodiment, the header electrical connectors 102 include a deflectable latch 106 and the receptacle electrical connectors 104 include a catch 108 for the latch 106. Optionally, the latch 106 of the twelve position header connector (FIG. 3) may be different than the latch 106 of the eight position header electrical connector 102 (FIG. 2). For example, the latches 106 may have different lengths, may be made of different materials, may have different shapes, and the like. The catches 108 may have different sizes, shapes, number of teeth, and the like. The different latches 106 and/or catches 108 have different audio signatures when latching to the corresponding catches 108. For example, when the latch 106 engages the catch 108 an audible click may be made, such as when the latch 106 snaps down into position behind the catch 108 (or multiple clicks may be heard when multiple teeth are provided). The latch 106 and/or catch 108 may be designed to have prominent audio signatures. Providing different latches 106 and/or catches 108 provides different audio signatures when the electrical connectors 102, 104 are mated. The mating assurance system 100 may be configured to differentiate between the different audio signatures of the different types of electrical connectors 102, 104 to identify the particular electrical connectors 102, 104 that are mated. Additionally, the audible sound produced when the latches 106 engage the corresponding catches 108 may have different audible characteristics depending on the orientation of the latches 106 or catches 108 relative to the microphones 110, 111 (e.g., on the top surface facing the microphones versus on the bottom with the assemblers hand between the microphones and the latches/catches). The mating assurance system 100 may be able to differentiate when the electrical connectors 102, 104 are in different orientations.

Returning to FIG. 1, the microphones 110, 111 detect the latch click(s) that occurs when the latch 106 is latched, signifying that the electrical connectors 102, 104 are properly mated. The audio signals, including the audio signals corresponding to the latch click, are transmitted to the output unit 114. The output unit 114 processes the audio signals and provides feedback to the assembler.

In an exemplary embodiment, the output unit 114 provides audible feedback to the assembler based on the audio signals. For example, a speaker 116 may be coupled to the output unit 114 and output from the output unit 114 may cause the speaker 116 to provide audible feedback. The speaker 116 may enhance (e.g., make louder) the click detected by the microphones 110,111 to make it easier or possible for the assembler to hear.

In an exemplary embodiment, the output unit 114 provides visual feedback to the assembler at a display screen 118 coupled to the output unit 114. The display screen 118 may be a stationary monitor, such as a monitor setting on a desk, integrated into a computer or other system, or mounted to a wall, or may be a portable monitor, such as a monitor configured to be worn by or carried by the assembler. The display screen 118 may display visual confirmation that proper mating has occurred based on the audio signals processed by the output unit 114, such as by displaying a particular color, displaying a particular icon, displaying words and/or symbols, and the like. The output unit 114 may determine the type of the electrical connectors 102, 104 mated (e.g., eight position versus twelve position versus another type) and may display information relating to the particular type of electrical connectors 102, 104 that have been mated. For example, during a particular assembly, the assembler may need to mate a four position connector, an eight position connector and a twelve position connector. After the assembler performs the mating, the assembler may refer to the display screen 118 to verify that all three connectors where mated. The display screen 118 may indicate that only two of the connectors were actually mated, causing the assembler to return to the vehicle and figure out which connector was not properly mated. Alternatively, the output unit 114 may identify which of the connectors were mated based on the audio signals and indicate on the display screen 118 which of the three connectors were properly mated and/or which of the three connectors were not properly mated.

In an exemplary embodiment, the output unit 114 may include or be coupled to a template module 120 that includes different type templates of audio signatures (examples shown in FIG. 4) of different types of electrical connectors 102, 104 (e.g., 2 position, 4 position, 6 position, 8 position, 12 position, etc.). The template module 120 may include different orientation templates of audio signatures of the various electrical connectors 102, 104 at different orientations (e.g., top-up, bottom-up, side-up and the like). The output unit 114 may compare the received audio signal from the microphones 110, 111 to the various templates to determine which type of electrical connectors 102, 104 was mated and/or the orientation of the electrical connectors 102, 104 in the mating zone 112 when mated. For example, the template module 120 may have different time domain characteristics and/or frequency domain characteristics for the different types of electrical connectors 102, 104 and/or for the different orientations. The output unit 114 may correlate the audio signals against time domain templates and/or frequency domain templates to identify the particular type of electrical connectors 102, 104 that are mated and/or to determine the orientation of the electrical connectors 102, 104 during mating. Having different orientation templates allows the system to account for different audible characteristics of the latching when a particular electrical connector type is mated, which may lead to a false-negative determination in systems that do not include multiple orientation templates.

In an exemplary embodiment, the output unit 114 may include or be coupled to a calibration module 122 that is used to calibrate the output unit 114 and/or the template module 120. For example, in a calibration mode, the electrical connectors 102, 104 may be mated, preferably numerous times and/or in various orientations to increase the amount of data to calibrate the output unit 114 and/or template module 120. Time domain characteristics, frequency domain characteristic and/or other characteristics of the audio signal associated with the mating (e.g. the click) detected by the microphone 110 may be recorded and a median or average time domain template, frequency domain template and/or other type of template may be determined for each type of electrical connector 102, 104 (e.g., 2 position, 4 position, 6 position, 8 position, 12 position, etc.) that may be assembled and monitored by the mating assurance system 100. The output unit 114 may be calibrated and programmed for use with any number of different types of electrical connectors 102, 104. Based on the unique signatures of the audible sound made when the particular types of electrical connectors 102, 104 are mated and/or when the particular electrical connectors 102, 104 are mated at various orientations, the output unit 114 is able to identify and determine exactly which type of electrical connectors 102, 104 have been mated at any particular time. The output unit 114 provides feedback at the display screen 118 for the assembler to identify which types of electrical connectors 102, 104 have been mated.

In an exemplary embodiment, the output unit 114 includes or is electrically connected to any electronic verification module 124. The electronic verification module 124 sends signals through the electrical connectors 102, 104 to verify that the electrical connectors 102, 104 are electrically connected. The output unit 114 may verify which electrical connectors 102, 104 have affirmatively passed the electronic verification module 124 and compare such list of electrical connectors 102, 104 with the list of electrical connectors 102, 104 that have affirmatively passed audible verification. Data from the output unit 114 and/or electronic verification module 124 may be sent to a master quality control database or system on the vehicle or at the assembly plant for review and/or verification of successful assembly of the electrical connectors 102, 104. Such information may be combined with information from other modules or systems.

As used herein, the terms "system," "unit," or "module" may include a hardware and/or software system that operates to perform one or more functions. For example, a module, unit, or system may include a computer processor, controller, or other logic-based device that performs operations based on instructions stored on a tangible and non-transitory computer readable storage medium, such as a computer memory. Alternatively, a module, unit, or system may include a hard-wired device that performs operations based on hard-wired logic of the device. Various modules or units shown in the attached figures may represent the hardware that operates based on software or hardwired instructions, the software that directs hardware to perform the operations, or a combination thereof.

"Systems," "units," or "modules" may include or represent hardware and associated instructions (e.g., software stored on a tangible and non-transitory computer readable storage medium, such as a computer hard drive, ROM, RAM, or the like) that perform one or more operations described herein. The hardware may include electronic circuits that include and/or are connected to one or more logic-based devices, such as microprocessors, processors, controllers, or the like. These devices may be off-the-shelf devices that are appropriately programmed or instructed to perform operations described herein from the instructions described above. Additionally or alternatively, one or more of these devices may be hard-wired with logic circuits to perform these operations.

It should be noted that the particular arrangement of components (e.g., the number, types, placement, or the like) of the illustrated embodiments may be modified in various alternate embodiments. In various embodiments, different numbers of a given module or unit may be employed, a different type or types of a given module or unit may be employed, a number of modules or units (or aspects thereof) may be combined, a given module or unit may be divided into plural modules (or sub-modules) or units (or sub-units), a given module or unit may be added, or a given module or unit may be omitted.

It should be noted that the various embodiments may be implemented in hardware, software or a combination thereof. The various embodiments and/or components, for example, the units, modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optical drive, and the like. The storage device may also be other similar means for loading computer programs or other instructions into the computer or processor.

As used herein, the term "computer" and "controller" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "controller" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

Figure 4:
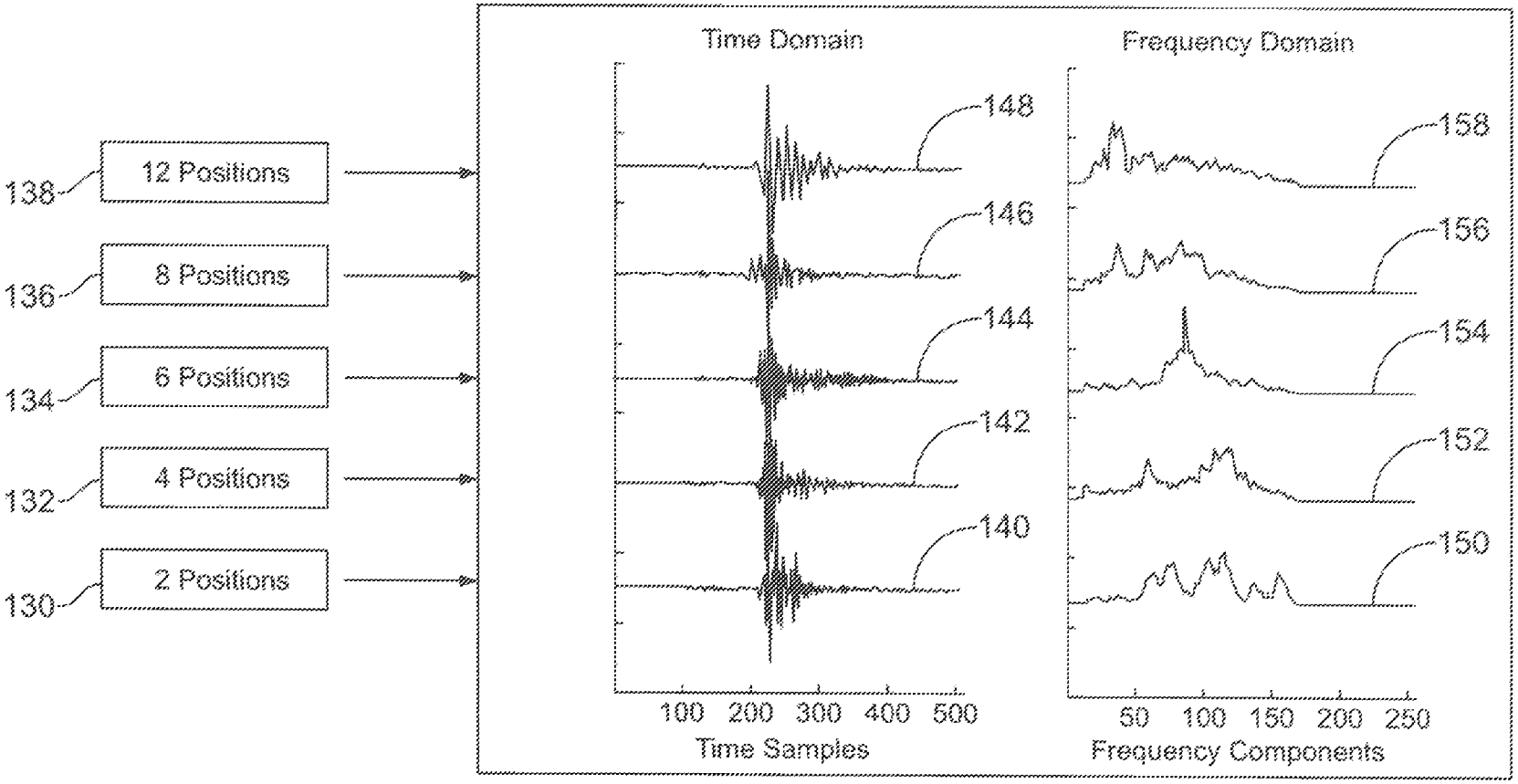
FIG. 4 illustrates exemplary templates of audio signatures corresponding to latching or mating of different pairs of electrical connectors.

FIG. 4 illustrates exemplary templates of audio signatures corresponding to latching or mating (e.g., audible click) of different pairs of electrical connectors 130, 132, 134, 136, 138. The pairs of electrical connectors 130, 132, 134, 136, 138 may be 2 position, 4 position, 6 position, 8 position, and 12 position electrical connectors, respectively; however templates for other types of connectors may be developed in other embodiments. FIG. 4 illustrates time domain templates 140, 142, 144, 146, 148 for the five different pairs of electrical connectors 130, 132, 134, 136, 138, respectively. Each of the time domain templates 140, 142, 144, 146, 148 has a unique signature. FIG. 4 illustrates frequency domain templates 150, 152, 154, 156, 158 for the five different pairs of electrical connectors 130, 132, 134, 136, 138, respectively. Each of the frequency domain templates 150, 152, 154, 156, 158 has a unique signature. The time domain templates 140, 142, 144, 146, 148 and/or frequency domain templates 150, 152, 154, 156, 158 may be compared to any audio signal received at the mating assurance system 100 (shown in FIG. 1) to detect the click sound and determine the type of connectors that are mated.

Figure 5:
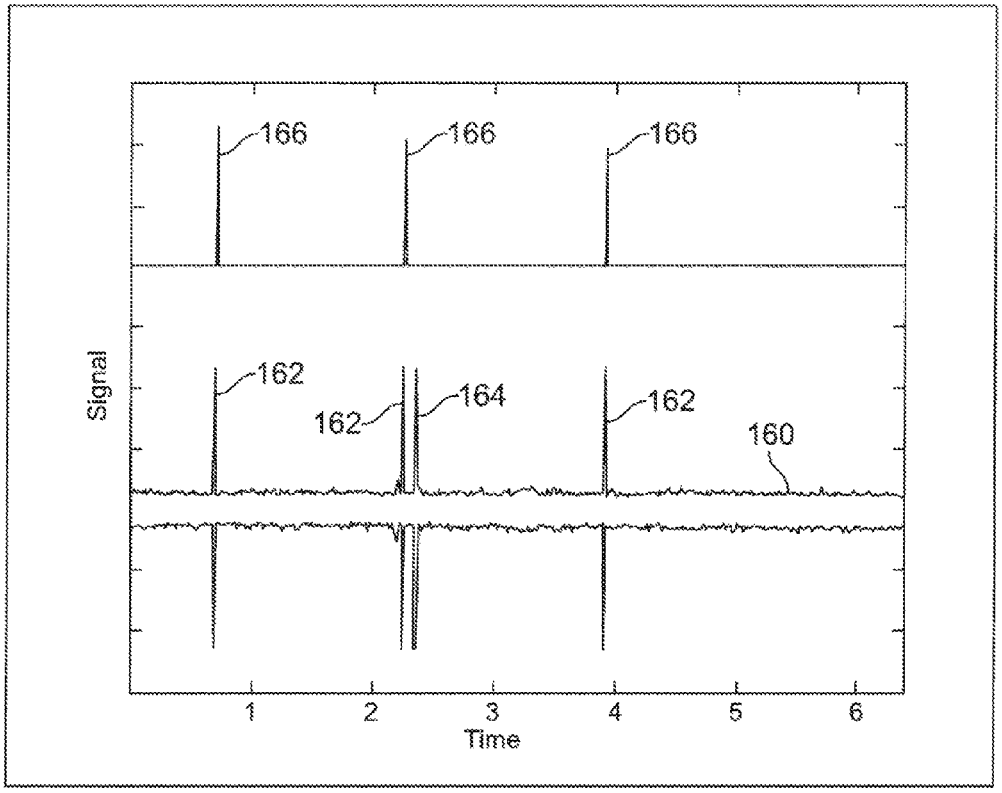
FIG. 5 is a chart showing audible detection of latching or mating of electrical connectors using the mating assurance system.

FIG. 5 is a chart showing audible detection of latching or mating of connectors using the mating assurance system 100 (shown in FIG. 1). The recorded data 160 is processed by the output unit 114 over time. The output unit 114 detects events 162, which may correspond to latching or mating of the connectors, and false events 164, which may occur when the microphone 110 or 111 touches something, when the connectors touch some other component, such as if the connectors are touched together but not mated or if the connectors are dropped, when other noises occur in the assembly facility, such as using other tools or machines around the assembly factory, and the like. The false events 164 may be identified by the output unit 114, such as by analyzing the audio signatures of such false events 164 and comparing the audio signatures to the templates. Using multiple microphones 110, 111 aids in detecting false events by allowing the output unit 114 to detect the direction of origination of the audible sound and determining if the origination location is in the mating zone 112 or is outside of the mating zone 112. The output unit 114 may ignore noises that sound like a click of mating connectors, but that originate from a direction different than the location of the electrical connectors 102, 104 (e.g., the mating zone 112). The output unit 114 ignores audio signals determined to originate from a direction other than the mating zone 112. The events 162 may be verified by comparing the audio signatures of the recorded data 160 to the templates. The time domain templates 140, 142, 144, 146, 148 and/or frequency domain templates 150, 152, 154, 156, 158 may be used to compare to the recorded data 160. When an event 162 is detected, the output unit 114 may provide audible, visual or other feedback outputs 166 to the assembler to confirm that the connectors are properly mated.

In an exemplary embodiment, the events 162 may be verified by comparing the audio signatures from the first microphone 110 and the audio signatures of the second microphone 111. The output unit 114 is able to estimate the delay between the times when a sound strikes each microphone 110, 111 by monitoring the average power of the digitized signals that are present on the microphones 110, 111. The output unit 114 may analyze the audio signals using cross correlation of the audio signals. The output unit 114 may analyze the audio signals using direction-of-arrival (DOA) methods. In an exemplary embodiment, the output unit 114 determines an origination distance from the electrical connectors 102, 104 to the second microphone 111 based on a timed difference between receipt of the audible sound at the first microphone 110 and receipt of the audible sound at the second microphone 111.

Figure 6:
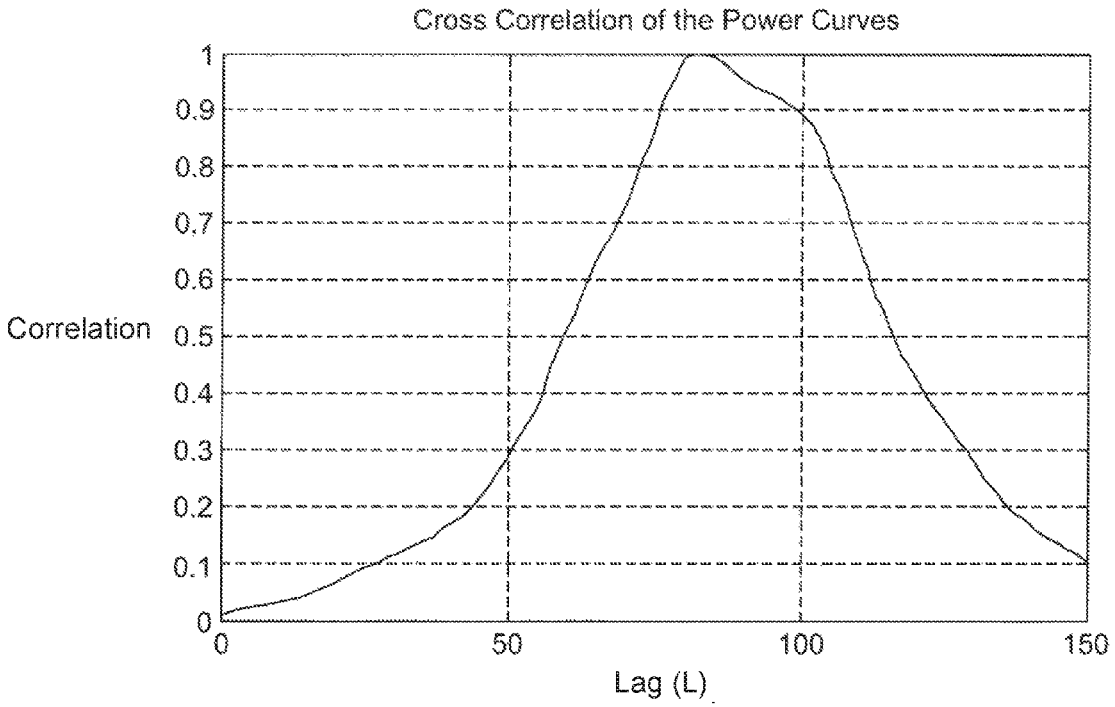
FIG. 6 is a cross correlation of power curves chart in accordance with an exemplary embodiment.

FIG. 6 illustrates an exemplary cross correlation of power curves chart. The cross correlation power curve shows the lag L in time along the x-axis and the correlation along the y-axis. The cross correlation power curve can be used to estimate audio signal travel distance between two microphones, such as using a formula [D=100*341*Peak/44100]). The maximum of the cross correlation of the average power waveform of the microphones 110, 111 provides an estimate of the time delay or lag L in samples between them. Multiplying the lag L by the sampling rate provides the result in seconds. Multiplying the result by the speed of sound (e.g., sound travels at about 341 m/sec in air) provides the result as a travel distance D. The travel distance D may represent the relative difference in distance from the source of the sound to the first microphone 110 and from the source of the sound to the second microphone 111. From such travel distance D determination, the output unit 114 may determine a direction of the sound origin. The output unit 114 may utilize other direction-of-arrival (DOA) methods, such as those based on the Eigen value decomposition of the covariance matrix of the signals across an array of microphones, MUSIC algorithms, ESPRIT algorithms, and the like.

The signal-to-noise ratio (SNR) of the audio signals may be enhanced using deterministic or adaptive beamforming techniques across the several microphones 110, 111. For example, the output unit 114 may use a sum beam beamforming technique as a deterministic method to enhance the audio signal and analysis. In such technique, the outputs of multiple microphone signals are coherently summed to form a beam with directivity. A close to an omnidirectional microphone pattern can be transformed into a directional pattern. Adaptive beamforming techniques can be used if a source of noise impinging on the microphones 110, 111 from a direction other than the electrical connectors 102, 104 is known to exist. For example, the direction of the source can be estimated and a null can be placed in the beam pattern to eliminate its contribution to the received signal.

Figure 7:
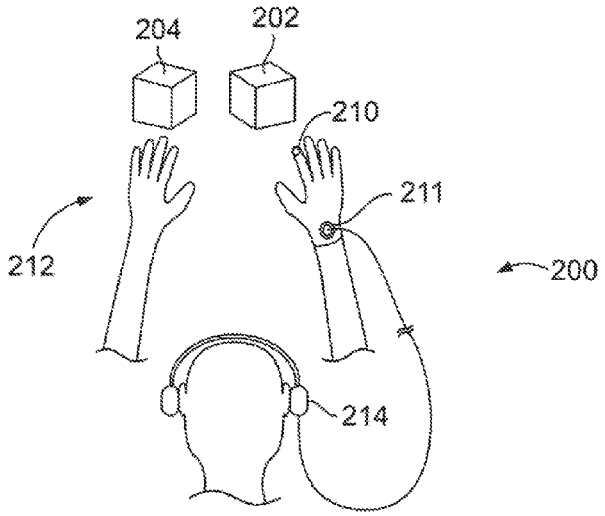
FIG. 7 illustrates a mating assurance system formed in accordance with an exemplary embodiment.

FIG. 7 illustrates a mating assurance system 200 formed in accordance with an exemplary embodiment. The mating assurance system 200 may be a specific embodiment of the mating assurance system 100 (shown in FIG. 1). The mating assurance system 200 provides audible feedback to an assembler to confirm that a pair of electrical connectors 202, 204 is properly mated. In an exemplary embodiment, the mating assurance system 200 detects an audible sound when the electrical connectors 202, 204 are mated.

The mating assurance system 200 includes first and second microphones 210, 211 that are located in a vicinity of a mating zone 212 for the electrical connectors 202, 204. In an exemplary embodiment, the first microphone 210 may be provided at or near the fingertips of the assembler while the second microphone 211 may be provided at or near the wrist of the assembler. For example, the microphones 210, 211 may be strapped to the assembler's hand or may be integrated into a glove worn by the assembler. Alternatively, the microphones 210, 211 may be otherwise positioned within the mating zone 212 in the vicinity where the assembler is mating the electrical connectors 202, 204, such as being fixed in place in the mating zone 212. The microphone 210 may be embedded into or otherwise coupled to the electrical connectors 202 and/or 204.

The microphones 210, 211 are connected to an output unit 214 and the output unit 214 receives audio signals from the microphones 210, 211. The output unit 214 processes the audio signals and provides an audible output or feedback. In an exemplary embodiment, the output unit 214 includes a speaker that provides an audible output. The output unit 214 may include an ear bud or headphone worn by the assembler to provide audible feedback to the assembler based on the audio signals. The mating assurance system 200 enhances the audible sound providing various types of feedback to the assembler to ensure that the electrical connectors 202, 204 are properly mated. The output unit 214 may filter background noise to enhance the audible sound for the assembler. The output unit 214 may cross-correlate the audio signals from both microphones 210, 211 to verify that the direction of the sound origin originated in the mating zone 212, otherwise filtering such audio signals out as being from other audio sources.

To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like) or multiple pieces of hardware. Similarly, the programs may be stand-alone programs, may be incorporated as subroutines in an operating system, may be functions in an installed software package, and the like. It should be understood that the various embodiments are not limited to the arrangements and instrumentality shown in the drawings.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A mating assurance system comprising:

first and second microphones configured to be located in a vicinity of a mating zone for electrical connectors, the first microphone being located a first distance from the mating zone and the second microphone being located a second distance from the mating zone, the first and second microphones configured to detect audible sound when the electrical connectors are mated; and an output unit connected to the first and second microphones and receiving audio signals from the first and second microphones, the output unit processing the audio signals from the first microphone and from the second microphone for mating assurance, wherein the output unit compares the audio signals from the first microphone with the audio signals from the second microphone for mating assurance.

2. The mating assurance system of claim 1, wherein the output unit determines a direction of origination of the audible sounds.

3. The mating assurance system of claim 1, wherein the output unit compares the audio signals from the first microphone with the audio signals from the second microphone to determine a direction of origination of the audible sounds.

4. The mating assurance system of claim 3, wherein the output unit ignores audio signals determined to originate from a direction other than the mating zone.

5. The mating assurance system of claim 1, wherein the output unit determines a mating orientation of the electrical connectors based on the audio signals from at least one of the first microphone and the second microphone.

6. The mating assurance system of claim 1, wherein the output unit determines an origination distance from the electrical connectors to the second microphone based on a timed difference between receipt of the audible sound at the first microphone and receipt of the audible sound at the second microphone.

7. The mating assurance system of claim 1, wherein the first microphone is configured to be worn by an assembler proximate to the assembler's finger tips and the second microphone is configured to be worn by the assembler proximate to the assembler's wrist.

8. The mating assurance system of claim 1, wherein the output unit filters background noise based on the time the audio signals are received at the first microphone and at the second microphone.

9. The mating assurance system of claim 1, further comprising a third microphone configured to be located in the vicinity of the mating zone, the output unit connected to the third microphone and receiving audio signals from the third microphone, the output unit processing the audio signals from the third microphone.

10. The mating assurance system of claim 1, wherein the microphone detects the audible sound that occurs when a latch of one electrical connector latches to the corresponding electrical connector.

11. The mating assurance system of claim 1, wherein the output unit provides at least one of visual feedback to an assembler at a display screen and audio feedback to an assembler at a speaker based on the audio signals.

12. The mating assurance system of claim 1, wherein the output unit compares the audio signal to a plurality of templates to determine the type of electrical connectors mated.

13. The mating assurance system of claim 1, wherein the output unit compares the audio signal to a plurality of templates to determine the orientation of the electrical connectors.

14. A mating assurance system comprising:

first and second microphones configured to be located in a vicinity of a mating zone for electrical connectors, the first and second microphones configured to detect audible sound; and an output unit connected to the first and second microphones and receiving audio signals from the first and second microphones, the output unit processing the audio signals from the first microphone and from the second microphone to determine a direction of origination of the audible sounds, and the output unit compares the audio signals from the first microphone with the audio signals from the second microphone for mating assurance.

15. The mating assurance system of claim 14, wherein the output unit determines an origination distance from the electrical connectors to the second microphone based on a timed difference between receipt of the audible sound at the first microphone and receipt of the audible sound at the second microphone.

16. A method of detecting electrical connector mating, the method comprising:

positioning a first microphone in a vicinity of a mating zone for the electrical connectors;

positioning a second microphone in a vicinity of the mating zone for the electrical connectors;

detecting audible sounds with the first and second microphones when the electrical connectors are mated;

transmitting audio signals based on the audible sounds detected by the first and second microphones to an output unit;

processing the audio signals from the first and second microphones at the output unit by comparing the audio signals from the first microphone with the audio signals from the second microphone for mating assurance.

17. The method of claim 16, wherein said processing the audio signals comprises determining a time difference between receipt of the audible sound at the first microphone and receipt of the audible sound at the second microphone.

18. The method of claim 16, wherein said processing the audio signals comprises determining a direction of origination of the sound by comparing the audio signals of the first and second microphones.

* * * * *